United States Patent [19]

Chambard

[11] 4,212,052

[45] Jul. 8, 1980

[54] ASSEMBLABLE AND DISASSEMBLABLE LAMP SHADE

[76] Inventor: Carol K. Chambard, 301 N. Walker Ave., Wayzata, Minn. 55391

[21] Appl. No.: 928,319

[22] Filed: Jul. 26, 1978

[51] Int. Cl.[2] ..... F21V 1/06

[52] U.S. Cl. ..... 362/352; 2/DIG. 6; 362/358

[58] Field of Search ..... 362/351, 352, 358; 2/DIG. 6

[56] References Cited

U.S. PATENT DOCUMENTS

| | | | |
|---|---|---|---|
| 3,057,354 | 10/1962 | Roberts et al. | 2/DIG. 6 |
| 3,142,446 | 7/1964 | Okamoto | 362/352 |

OTHER PUBLICATIONS 1,001 Decorating Ideas, P.N.R. #1116, 9/6/71.

*Primary Examiner*—L. T. Hix
*Assistant Examiner*—Thomas H. Tarcza
*Attorney, Agent, or Firm*—Peterson, Palmatier, Sturm & Sjoquist, Ltd.

[57] ABSTRACT

The lamp shade comprises a cover fabricated from a generally rectangular sheet of flexible material to which composite tape units are attached adjacent the upper and lower edges thereof. Each tape unit includes a first pile-type fastener tape having its back side secured to the sheet adjacent the top edge thereof, a fabric tape attached to the first pile-type fastener tape and a second pile-type fastener tape attached to the fabric tape along the edge thereof opposite the edge to which the first pile-type fastener tape is attached so that the fabric tape can be looped or folded about a conventional lamp shade ring and the second pile-tape fastener tape then releasably engaged with the first pile-type fastener tape to maintain the sheet of flexible material in a generally cylindrical configuration. Adjacent the end edges of the sheet are additional Velcro tapes which are releasably engageable in order to retain the end edges in an overlapped relationship, thereby further assisting in maintaining the generally cylindrical configuration of the lamp shade.

9 Claims, 9 Drawing Figures

ASSEMBLABLE AND DISASSEMBLABLE LAMP SHADE

BACKGROUND OF THE INVENTION

1. Field of the Invention

This invention relates generally to lamp shades, and pertains more particularly to a lamp shade that can be assembled from component parts and readily disassembled when it is desired to do so.

2. Description of the Prior Art

Various types of collapsible lamp shades have been devised in the past. Some of these shades have been quite complex and the intricacy has, it is believed, discouraged their widespread use. Also, some have involved rather elaborate clip arrangements which have either made the shade difficult to assemble and disassemble, or have rendered the shade so costly that they have not been extensively adopted. Still others have not provided the leeway that one normally would like to have as far as providing lamp shades of different sizes, colors and patterns.

SUMMARY OF THE INVENTION

Accordingly, one object of the present invention is to provide a lamp shade that can be quickly and easily assembled and disassembled.

Another object of the invention is to provide a lamp shade having a cover that can be constructed of different materials. In this regard, an aim of the invention is to utilize parchment, cardboard, cloth and the like as the specific flexible cover material.

Another object is to provide a lamp shade that can be shipped in a flat condition, thereby economizing on transportation costs. More specifically, in the past the shipping of lamp shades in their three-dimensional form has been quite costly, largely because of the considerable volume that each shade occupies. Also, an aim of the invention is to provide smaller cartons than would be required when the shade is fully assembled, as has been the situation in the past. Cartons of large size are expensive and this saving in carton costs is in addition to the savings directly attributable to transportation.

Also, an object of the invention is to enable the user of a lamp shade to store it more readily than heretofore, mainly inasmuch as it can be readily disassembled and stored in a substantially flat condition.

With so many people moving nowadays, either to new homes or on trips, another object of the invention is to provide a shade that can be taken apart and packed in a substantially flat condition so that it can be taken with the family or by the individual if traveling alone. In either case, the shade lends itself readily to being taken apart and reassembled very quickly.

Still further, an object of the invention is to provide a lamp shade in which its cover can be changed quite readily, thereby permitting the user to switch from one cover color or pattern to another. In this regard, it is planned that the rings conventionally utilized in a lamp shade be reused with various cover materials when practicing the teachings of my invention.

Closely associated with the foregoing object is the further object of providing a lamp shade in which its cover can be changed back and forth quite frequently, it being within the purview of my invention to change covers on a lamp shade from season to season.

Still another object of the invention is to provide a readily assembled and disassembled lamp shade which will not only be simple and easy to erect and to knock down, but which will be relatively inexpensive to manufacture.

A still further object is to provide a lamp shade that lends itself readily to being marketed in a kit form, the purchaser in such a case having even greater choices as to shade designs, sizes and colors.

Briefly, my invention envisages a rectangular sheet or panel of flexible material forming the cover for the lamp shade to which is secured various pile-type fastener tapes. As far as the upper and lower edges of the lamp shade are concerned, identical tape units are employed, each tape unit including a pair of cooperate pile-type fastener tapes which are stitched to the opposite side edges of a fabric bias tape. The back side or reverse side of one pile-type fastener tape of each unit is adhesively attached to the side of the flexible sheet or panel that is to constitute the inner surface of the cover. The fabric tape can be readily folded or looped about one conventional lamp shade ring to form the upper edge of the lamp shade, and similarly the fabric of the lower tape unit can be folded about a second conventional ring to form the lower or bottom edge. After looping the fabric tape about the rings, then the pile-type fastener tape that has not been adhesively secured to the cover sheet can be releasably engaged with the pile-type fastener tape that has been adhesively secured to this sheet. Additional pile-type fastener tapes extend along the vertical or end edges of the cover sheet or panel so that when the end edges are overlapped these pile-type fastener tapes can be releasably engaged with each other to further assure a generally cylindrical lamp shade.

DESCRIPTION OF THE PREFERRED EMBODIMENT

Figures 1, 2, 3, 4, 5, 6, 7, 8, 9:
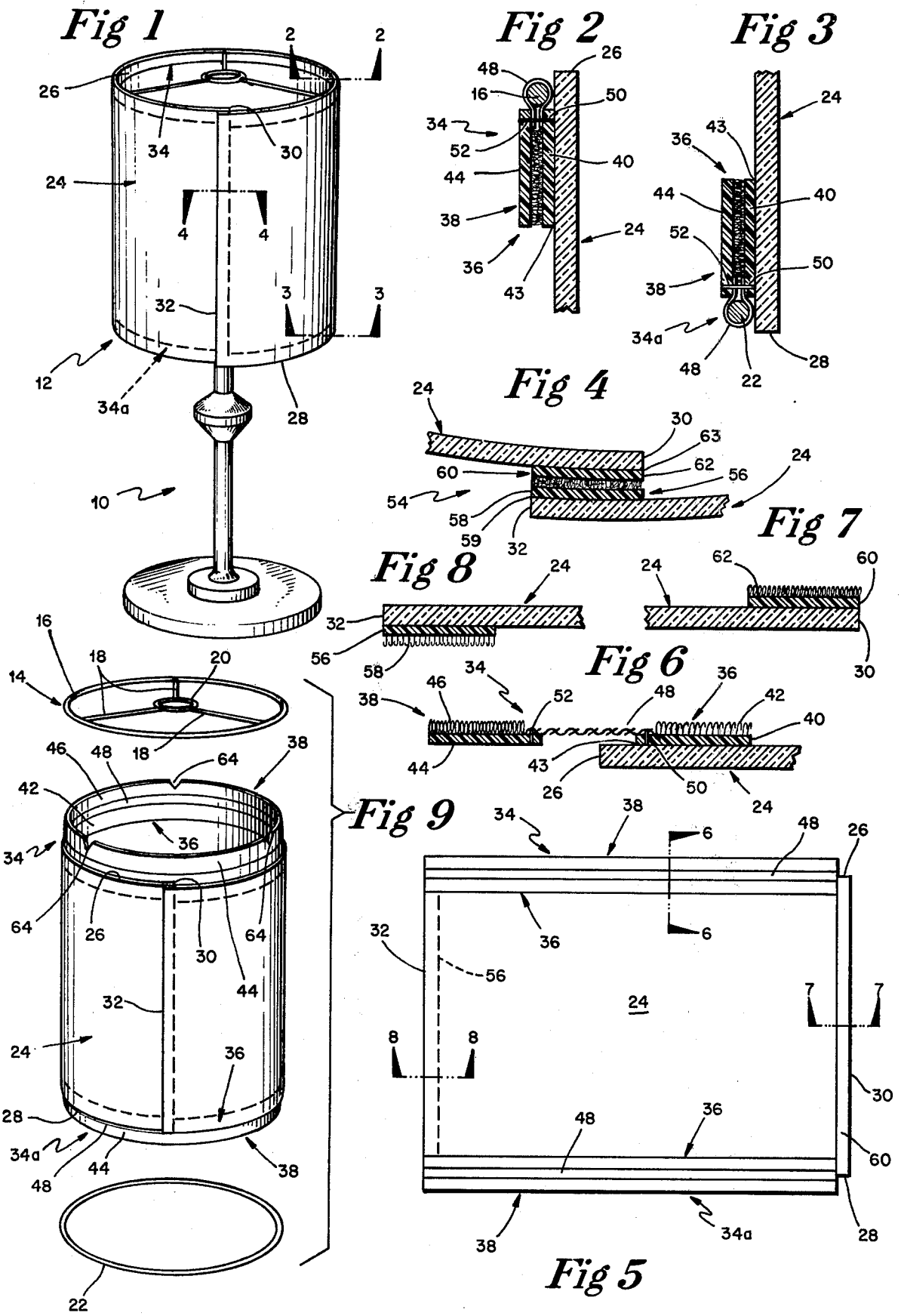
FIG. 1 is a perspective view of a lamp utilizing a shade constructed in accordance with the teachings of my invention.
FIG. 2 is a sectional detail taken in the direction of line 2—2 of FIG. 1 in order to illustrate how the upper portion of the cover is releasably fastened to a conventional upper ring.
FIG. 3 is a sectional detail taken in the direction of line 3—3 for the purpose of showing how the lower portion of the cover is similarly engaged with a second or bottom ring.
FIG. 4 is a sectional detail taken in the direction of line 4—4 of FIG. 1 for the purpose of illustrating how the overlapped end sections of the lamp shade cover are releasably held together.
FIG. 5 is a top plan view of a rectangular flexible sheet or panel which is to constitute the lamp shade cover with the various pile-type fastener tapes secured to the marginal portions thereof.
FIG. 6 is an enlarged sectional detail taken in the direction of line 6—6 of FIG. 5.
FIG. 7 is an enlarged sectional detail taken in the direction of line 7—7 of FIG. 5.
FIG. 8 is an enlarged sectional view taken in the direction of line 8—8 of FIG. 5.
FIG. 9 is an exploded perspective view depicting conventional rings spaced upwardly and downwardly with respect to a partially completed shade.

A typical lamp 10 has been presented in FIG. 1. Inasmuch as the construction of the lamp is not important to a practicing of my invention, it need not be referred to in any detail.

FIG. 1, however, pictures a lamp shade in accordance with my invention which has been fully assembled, the complete lamp shade having been denoted by the reference numeral 12. A conventional upper frame unit 14 (best viewed in FIG. 9) includes a circular ring 16, several inwardly extending spokes or struts 18 and a central hub 20. Some frames 14, though, make use of a resilient wire clip instead of the hub 20 which clips onto the light bulb itself. It should be understood that my invention lends itself readily to use with virtually any type of frame at the top employing a circular ring. By the same token, the conventional frame at the bottom is even simpler than that at the top, constituting only a circular ring 22.

A sheet or panel of flexible material is intended to serve as the cover, being indicated generally by the reference numeral 24. The material can be parchment, cardboard or some form of fabric. More specifically, the sheet or panel 24 has an upper edge 26, a lower edge 28, an end edge 30 and an opposite end edge 32.

Playing an important role in the practicing of my invention are two tape units 34 and 34*a*. Since these tape units 34, 34*a* are of identical construction, it is only necessary to refer to one such unit. In this regard, the unit 34 (or 34*a*) includes a first pile-type fastener tape 36 and a second, pile-type fastener tape 38, the tape 36 having a plastic backing strip 40 and a multiplicity of J-shaped plastic hooks 42 projecting from the front side thereof. The back side of the strip 40 is adhesively secured at 43 to the side of the panel or sheet 24 that is to constitute the inner surface of the cover or completed shade 12, being spaced somewhat from what becomes the upper edge 26 in FIGS. 1 and 9. The second pile-type fastener tape 38 includes a plastic strip 44 having a multiplicity of small plastic loops 46 projecting from one side thereof and which loops are releasably engageable and disengageable with the J-shaped hooks 42 belonging to the first pile-type fastener tape 36.

As will presently become manifest, the pile-type fastener tapes 36 and 38 of the tape unit 34 (or 34*a*) are retained in a laterelly spaced relationship. In this regard, a strip of flexible fabric bias tape 48 has its edges stitched at 50 and 52 to the pile-type fastener tapes 36 and 38, the stitching 50 attaching the fabric tape 48 to the plastic strip 40 forming part of the pile-type fastener tape 36 and the stitching 52 attaching the opposite edge of the fabric tape 48 to the plastic strip 44 forming part of the pile-type fastener tape 38. It is important to appreciate that the flexible fabric tape 48 is readily foldable; the reason for this will soon be explained.

Whereas the tape unit 34 is secured to the panel or sheet 24 adjacent what becomes the upper edge of the shade 12, the tape unit 34*a* is similarly secured to the panel or sheet 24 adjacent what becomes the lower edge 28. Thus, the plastic strips 40 of the tape units 34 and 34*a* are adhesively secured to what will constitute the inner surface of the cover of the lamp shade 12 when fully assembled.

Attention is directed now to a somewhat different tape unit 54. The tape unit 54 includes a pile-type fastener tape 56 comprising a plastic backing strip 58 having J-shaped hooks (not identifiable in FIG. 4 but like the hooks 42 and 58 of FIGS. 6 and 8) extending from the front side thereof. The reverse or back side of the plastic strip 58 is adhesively secured at 59 to what will constitute the inner surface of the cover of the completed shade 12, being located adjacent the end edge 32. Similarly, the second pile-type fastener tape 60 belonging to the tape unit 54 includes a plastic strip 62 having a multiplicity of plastic loops (not identifiable in FIG. 4 but like the loops 46 and 62 of FIGS. 6 and 7 ) projecting from one side thereof, the other side or back side of the strip 62 being adhesively secured at 63 to the outer surface of the sheet or panel 24, being secured adjacent the end edge 30.

Attention is at this time directed to FIG. 9 which is an exploded perspective view of certain components utilized in the construction of the lamp shade 24. The upper frame 14 has already been referred to. Owing to the presence of the struts 18, it becomes important to accomodate these struts 18 when folding the fabric bias tape 48 about the segmental portions of the ring 16. Therefore, notches 64 have been cut in the pile-type fastener tape 38 so as to enable the folding of the fabric tape 48 about the circular ring 16 without interference with the struts 18 when releasably engaging the pile-type fastener tape 38 with the tape 36. Since the lower ring 22 has no inwardly extending struts, notches are not needed in the pile-type fastener tape 38 of the bottom tape unit 34*a*.

Having presented the foregoing information, the benefits to be derived from my invention are believed obvious and straightforward. Nonetheless, a brief sequential description of the manner in which the shade 12 is assembled will be of some assistance, it is believed, in fully appreciating my invention. Therefore, all that has to be available at the outset is a supply of flexible material from which a generally rectangular panel or sheet 24 can be cut. The sheet or panel 24 thus includes the previously alluded to upper edge 26, lower edge 28 and the end edges 30, 32.

From FIG. 5, it can be understood that the particular plastic strip 40 belonging to the pile-type fastener tape 36 is adhesively secured at 43 (FIG. 2) to the portion of the flexible sheet or panel 24 at a location near the upper edge 26. The same thing is done with respect to the bottom tape unit 34*a*, the plastic strip 40 belonging to the pile-type fastener tape 36 of the lower tape unit 34*a* being adhesively secured at 43 (FIG. 3) to the panel or sheet 24 near the lower edge 28 thereof.

Still further, it is intended that the additional tape unit 54 be utilized. Therefore, when still in the planar or flat condition depicted in FIG. 5, the plastic strip 58 of the pile-type fastener tape 56 is adhesively secured at 59 (FIG. 4 ) to what will constitute the inner surface of the cover of the completed shade 12, this being done adjacent the end edge 32. Similarly, the additional pile-type fastener tape 60 having the plastic strip 62 a part thereof has the back side of the strip 62 secured at 63 (FIG. 4) to the outer surface which results when the shade 12 is fully assembled, the strip 62 being secured adjacent the end edge 30.

With pile-type fastener tape applied to all four edges of the flexible sheet or panel 24, as just described, the sheet 24 is now in readiness for being assembled into the shade 12. While not necessary at the outset to form the cylindrical configuration appearing in FIG. 9 in the manner now to be referred to, nonetheless FIG. 9 is believed to provide a facile understanding of how the invention is to be utilized. Thus, it will be noted or understood from FIG. 9 that the end edges 30 and 32 of the flexible sheet or panel 24 are overlapped and releasably held together by the engagement of the pile-type fastener tape 56 with the pile-type fastener tape 60 of the tape unit 54.

Inasmuch as the ring 16 belonging to the frame 14 at the top determines the cylindrical configuration of the lamp shade 12 when fully assembled, it is easier to flex the sheet or panel 24 into a generally cylindrical configuration about the ring 16. After this has been done, then the pile-type fastener tape 38 of the tape unit 34 can be folded inwardly and downwardly from the position shown in FIG. 9 (see also FIG. 6) so that the fabric tape 48 is looped or folded about the segmental portions of the ring 16. It is up to the person doing the assembling of the lamp shade 12 to cut first the notches 64 at the proper location so as to accomodate the outermost ends of the struts 18. After the notches 64 have been cut, then the pile-type fastener tape 38 can be easily flexed downwardly, the fabric tape 48 bending or folding about the ring 16. The pile-type fastener tape 38 can then be releasably engaged with the pile-type fastener tape 36 with the ring 16 held in the loop formed by the folding of the fabric tape 48 about the segmental portions of the ring 16 residing between the struts 18.

The releasable engagement of the tape 56 with the Velcro tape 60 can be deferred until the ring 16 has been fastened in place by the steps just mentioned. In any event, the pile-type fastener tape 56 and the pile-type fastener tape 60, when such action has been postponed, can be releasably engaged with each other at this time so as to hold and further maintain the cylindrical configuration of the lamp shade 12.

The person assembling the lamp shade 12 has a further choice as far as anchoring the ring 22 at the bottom. In this instance, the same procedure utilized in conjunction with the upper tape unit 34 is employed in holding the bottom ring 22 in place. Thus, the pile-type fastener tape 38 of the tape unit **34*a*, which is depicted in FIG. 9 as extending downwardly past the lower edge 28 of the flexible panel or sheet 24 is simply flexed upwardly so as to fold the fabric tape 48 about the ring 22. Since the bottom ring 22 has no struts, no need exists for notching the Velcro tape 38 belonging to the lower tape unit 22**.

The foregoing steps complete the assembling of the lamp shade 12. When the lamp shade 12 is to be disassembled, all that the user need do is to pull the pile-type fastener tape 38 of the upper tape unit 34 away from the pile-type fastener tape 36 to release the ring 16. The ring 22 is released in the same manner by simply pulling the pile-type fastener tape 38 away from the pile-type fastener tape 36 as far as the tape unit **34*a* is concerned. It should also be readily apparent that the pile-type fastener tape 56 can be pulled away from the pile-type fastener tape 60 of the tape unit 54, to release or separate the end edges 30 and 32** from each other, thereby completing the disassembling operation.

I claim:

1. An assemblable and disassemblable lamp shade comprising a sheet of flexible material having at least one edge, a first pile-type fastener tape having its back side secured to one side of said sheet adjacent said one edge thereof, a second pile-type fastener tape releasably engageable with said first pile-type fastener tape, and foldable means connected to and extending between adjacent edges of said pile-type fastener tapes, whereby said foldable means can be looped inwardly about a conventional lamp shade ring and said second pile-type fastener tape releasably engaged at said one side with said first pile-type fastener tape.

2. The lamp shade of claim 1 in which said foldable means includes a strip of fabric tape.

3. The lamp shade of claim 2 in which said pile-type fastener tapes are stitched to opposite marginal portions of said fabric tape.

4. The lamp shade of claim 3 in which the back side of said first pile-type fastener tape is adhesively secured to said one side of said sheet which one side is to constitute the inner surface of said lamp shade.

5. The lamp shade of claim 4 in which said sheet has second and third edges extending generally perpendicularly to said one edge, a third pile-type fastener tape having its back side adhesively secured to said inner surface of said sheet adjacent said second edge and a fourth pile-type fastener tape having its back side adhesively secured to the outer or other surface of said sheet adjacent said third edge.

6. An assemblable and disassemblable lamp shade comprising a generally rectangular panel of flexible material having generally parallel upper and lower edges and generally parallel opposite end edges, a first pile-type fastener tape having its reverse side thereof secured to one side of said panel adjacent its said upper edge, a fabric tape secured along the edge of said pile-type fastener tape adjacent the edge thereof nearer the upper edge of said panel, and a second pile-type fastener tape secured along the edge of said fabric tape remote from the edge thereof that is secured to said first pile-type fastener tape, whereby said fabric tape can be looped about a circular lamp shade ring and said second pile-type fastener tape releasably engaged at said one side with said first pile-type fastener tape to maintain said rectangular panel in a generally cylindrical configuration corresponding to the circular shape of said ring.

7. A lamp shade in accordance with claim 6 including a third pile-type fastener tape secured to said panel adjacent said lower edge thereof, a second fabric tape secured along the edge of said third pile-type fastener tape adjacent the edge thereof nearer the lower edge of said panel, and a fourth pile-type fastener tape secured along the edge of said second fabric tape remote from the edge thereof that is secured to said third pile-type fastener tape, whereby said fourth pile-type fastener tape can be releasably engaged with said third pile-type fastener tape to further assist in maintaining said rectangular panel in said generally cylindrical configuration.

8. A lamp shade in accordance with claim 7 including a fifth pile-type fastener tape having its back side secured to said rectangular panel adjacent one of said end edges and a sixth pile-type fastener tape having its back side secured to said rectangular panel adjacent said other end edge, whereby said sixth pile-type fastener tape can be releasably engaged with said fifth pile-type fastener tape to still further assist in maintaining said cylindrical configuration.

9. A lamp shade in accordane with claim 8 in which said first-mentioned ring includes a plurality of inwardly directed struts, said second pile-type fastener tape being provided with notches having a spacing corresponding to the spacing of said struts in order to accommodate outer end portions of said struts.

* * * * *